US010337782B2

(12) United States Patent
Beaulac

(10) Patent No.: US 10,337,782 B2
(45) Date of Patent: Jul. 2, 2019

(54) LIGHTWEIGHT, PORTABLE, EXTERNAL NUCLEATION FAN GUN

(71) Applicant: SNOW REALM HOLDINGS LLC, Fort Collins, CO (US)

(72) Inventor: Tad Beaulac, Hubbardston, MA (US)

(73) Assignee: Snow Realm Holdings, LLC, Fort Collins, CO (US)

( * ) Notice: Subject to any disclaimer, the term of this patent is extended or adjusted under 35 U.S.C. 154(b) by 20 days.

(21) Appl. No.: 15/487,105

(22) Filed: Apr. 13, 2017

(65) Prior Publication Data

US 2017/0336122 A1 Nov. 23, 2017

Related U.S. Application Data

(60) Provisional application No. 62/392,020, filed on May 18, 2016.

(51) Int. Cl.
*F25C 3/04* (2006.01)

(52) U.S. Cl.
CPC ..... *F25C 3/04* (2013.01); *F25C 2303/046* (2013.01); *F25C 2303/048* (2013.01); *F25C 2303/0481* (2013.01)

(58) Field of Classification Search
CPC ..... F25C 3/04; F25C 2303/046; F25C 2303/048; F25C 2303/0481
USPC ..... 239/2.2, 14.2
See application file for complete search history.

(56) References Cited

U.S. PATENT DOCUMENTS 649,177 A * 5/1900 Regli ..... B62B 13/18 280/9
3,337,234 A * 8/1967 Ishizuka ..... B62D 13/02 280/408
3,945,567 A * 3/1976 Rambach ..... F04F 5/466 239/14.2
3,979,061 A * 9/1976 Kircher ..... F25C 3/04 239/2.2
4,004,732 A * 1/1977 Hanson ..... F25C 3/04 239/14.2
4,083,492 A * 4/1978 Dewey ..... F25C 3/04 239/135
4,200,228 A 4/1980 Woerpel
4,222,519 A * 9/1980 Kircher ..... F25C 3/04 239/14.2
4,223,836 A * 9/1980 Eager ..... F25C 3/04 239/14.2
4,291,891 A * 9/1981 Blanchette ..... B62B 13/18 280/13
4,335,658 A 6/1982 VanderKelen
(Continued)

*Primary Examiner* — Arthur O. Hall
*Assistant Examiner* — Joseph A Greenlund
(74) *Attorney, Agent, or Firm* — William W. Cochran; Cochran Freund & Young LLC

(57) ABSTRACT

Disclosed is a fan gun snowmaker that utilizes an external nucleation device to create atomized water mist that is broken apart and frozen by a transverse air jet to create frozen nuclei, or snow seed. Further, flat spray nozzles that are normally used for spray washing and power washing are used that create a flat fan spray at the opening of the fan gun, rather than typical cone-shaped sprayers. The fan spray better disperses the water molecules into the cold, ambient air, which then combine with the frozen nuclei to create snowflakes. The fan gun is portable and lightweight and has anchors at each end that also function as jacks.

13 Claims, 10 Drawing Sheets

(56) References Cited

U.S. PATENT DOCUMENTS 4,493,457 A * 1/1985 Dilworth ..... F25C 3/04 239/14.2
4,593,854 A 6/1986 Albertsson
4,711,395 A * 12/1987 Handfield ..... F25C 3/04 239/14.2
4,813,598 A 3/1989 Kosik, Sr. et al.
4,828,175 A * 5/1989 Heufler ..... F25C 3/04 181/202
4,901,920 A 2/1990 Wollin
4,919,331 A * 4/1990 Kosik, Sr. ..... F25C 3/04 239/132.1
5,135,167 A * 8/1992 Ringer ..... F25C 3/04 239/14.2
5,167,367 A * 12/1992 VanderKelen ..... F04D 27/004 239/14.2
5,180,105 A * 1/1993 Teague ..... F25C 3/04 239/14.2
5,379,937 A 1/1995 Rothe
5,810,251 A * 9/1998 McKinney ..... F25C 3/04 239/2.2
5,836,513 A * 11/1998 Smith ..... F25C 3/04 239/2.2
5,884,841 A * 3/1999 Ratnik ..... F25C 3/04 239/14.2
6,039,265 A * 3/2000 Dupre ..... F25C 3/04 239/14.2
6,129,290 A * 10/2000 Nikkanen ..... B05B 7/0433 239/132.1
6,152,380 A * 11/2000 Dupre ..... B05B 7/0846 239/14.2
6,164,556 A * 12/2000 Dupre ..... F25C 3/04 239/14.2
6,223,995 B1 * 5/2001 Evans ..... A01G 13/065 239/14.1
6,378,778 B1 * 4/2002 Lurås ..... F25C 3/04 239/14.2
6,543,699 B1 * 4/2003 Dupre ..... B05B 7/0807 239/14.2
7,114,662 B1 * 10/2006 Nikkanen ..... B05B 7/0807 239/2.2
7,290,722 B1 11/2007 Ewald
2001/0030242 A1 * 10/2001 Jervas ..... F25C 3/04 239/14.2
2004/0035947 A1 * 2/2004 Ratnik ..... B05B 1/14 239/2.2
2007/0158453 A1 * 7/2007 Corona ..... B05B 1/202 239/14.2
2009/0032608 A1 * 2/2009 Kincade ..... F25C 3/04 239/2.2
2009/0114735 A1 * 5/2009 Collins ..... F25C 3/04 239/2.2
2010/0264233 A1 * 10/2010 Asikkala ..... B01J 2/04 239/8
2014/0284396 A1 * 9/2014 Nikkanen ..... F25C 3/04 239/14.2

* cited by examiner

LIGHTWEIGHT, PORTABLE, EXTERNAL NUCLEATION FAN GUN

BACKGROUND

Ski areas have relied on snowmaking apparatus for several decades to effectively extend the skiing and snowboarding season and provide a more reliable time period during which ski areas can offer services. Snowmaking equipment provides a base upon which additional snow, during the winter season, can accumulate and prevent exposure of the ground in heavily skied areas. As such, snowmaking equipment has been a valuable asset for ski areas.

There are essentially two different types of snowmaking equipment. One type is the fan gun type and the other is a tower/ground gun. Fan guns use a large fan with internal nucleators and ring sprayers that project water droplets out from the fan gun by 100 feet or more. Tower/ground guns are mounted on towers and on the ground and use internal nucleators and water sprayers using the pressure of the water to propel the water droplets out into the open air.

SUMMARY OF THE INVENTION

An embodiment of the invention may therefore comprise a method of making snow using a fan gun comprising: providing a structure for the fan gun that has sled skids and retractable wheels for movement over snow and non-snow surfaces; using a fan mounted on the structure, that blows air through a fan barrel to generate a column of air exiting the fan barrel; creating an atomized water mist in open air using an external nucleator by passing water under pressure through a nucleation nozzle; generating an expanded flow of compressed air using an air nozzle that intersects the atomized water mist in open air, the air nozzle located sufficiently close to the nucleation nozzle to break apart water particles of the atomized water mist and the expanded flow of compressed air being sufficiently expansive to freeze water particles of the atomized water mist, in open air, to create frozen water nuclei; creating a fan-shaped water spray using spray nozzles located at an opening of the fan barrel that intersect the column of air so that the fan-shaped spray and the frozen nuclei are projected by the column of air from the fan barrel and combine to create snowflakes.

An embodiment of the present invention may further comprise a fan gun for making snow comprising: a support structure; retractable wheels connected to the support structure; sled skids connected to the support structure; a fan barrel mounted on the structure; a fan connected to the fan barrel and disposed to blow air through the fan barrel and create a column of air that is projected out of the fan barrel; an external nucleator comprising: a nucleation nozzle that creates an atomized water mist by passing pressurized water through an opening in the nucleation nozzle; an air nozzle that generates an expanded flow of air from compressed air applied to the air nozzle, the air nozzle positioned to intersect the atomized water mist, the air nozzle located sufficiently close to the nucleation nozzle to break apart water particles of the atomized water mist and freeze the water particles, in open air, to create frozen water nuclei; at least one water ring disposed proximate to an opening of the fan barrel; a plurality of spray nozzles disposed on the water ring that create a fan shaped spray of water that is projected into the column of air that is projected out of the fan barrel.

An embodiment of the present invention may further comprise a fan gun for making snow having sprayers comprising: sprayer nozzles, that are otherwise used as spray cleaning nozzles, that are connected to at least one water ring disposed proximate to an opening of a fan barrel of the fan gun, the sprayer nozzles creating a fan-shaped water spray from pressurized water in the water ring that dispenses the water over a fan shaped area and allows the water to freeze in ambient air.

An embodiment of the present invention may further comprise an external nucleator for use in a fan gun for making snow comprising: a nucleation nozzle that creates an atomized water mist in open air by passing pressurized water through an opening in the nucleation nozzle; an air nozzle that generates an expanded flow of air from compressed air applied to the air nozzle, the air nozzle positioned on the external nucleator to intersect the atomized water mist in open air at a distance that is sufficiently close to the nucleation nozzle to break apart water particles of the atomized water mist and freeze the water particles to create frozen water nuclei.

An embodiment of the present invention may further comprise a method of making snow using a fan gun comprising: generating a column of air using a fan that blows air through a fan barrel; creating atomized water mist in open air by passing pressurized water through a nucleation nozzle in an external nucleator; causing a flow of expanded air from pressurized air applied to an air nozzle to intersect the atomized water mist in open air, the flow of expanded air having a velocity that is sufficient to break apart water particles in the atomized water mist, and the flow of expanded air being expanded sufficiently to substantially freeze the water particles of the atomized water mist creating frozen water nuclei for creating snow.

DETAILED DESCRIPTION OF THE EMBODIMENTS

Figure 1:
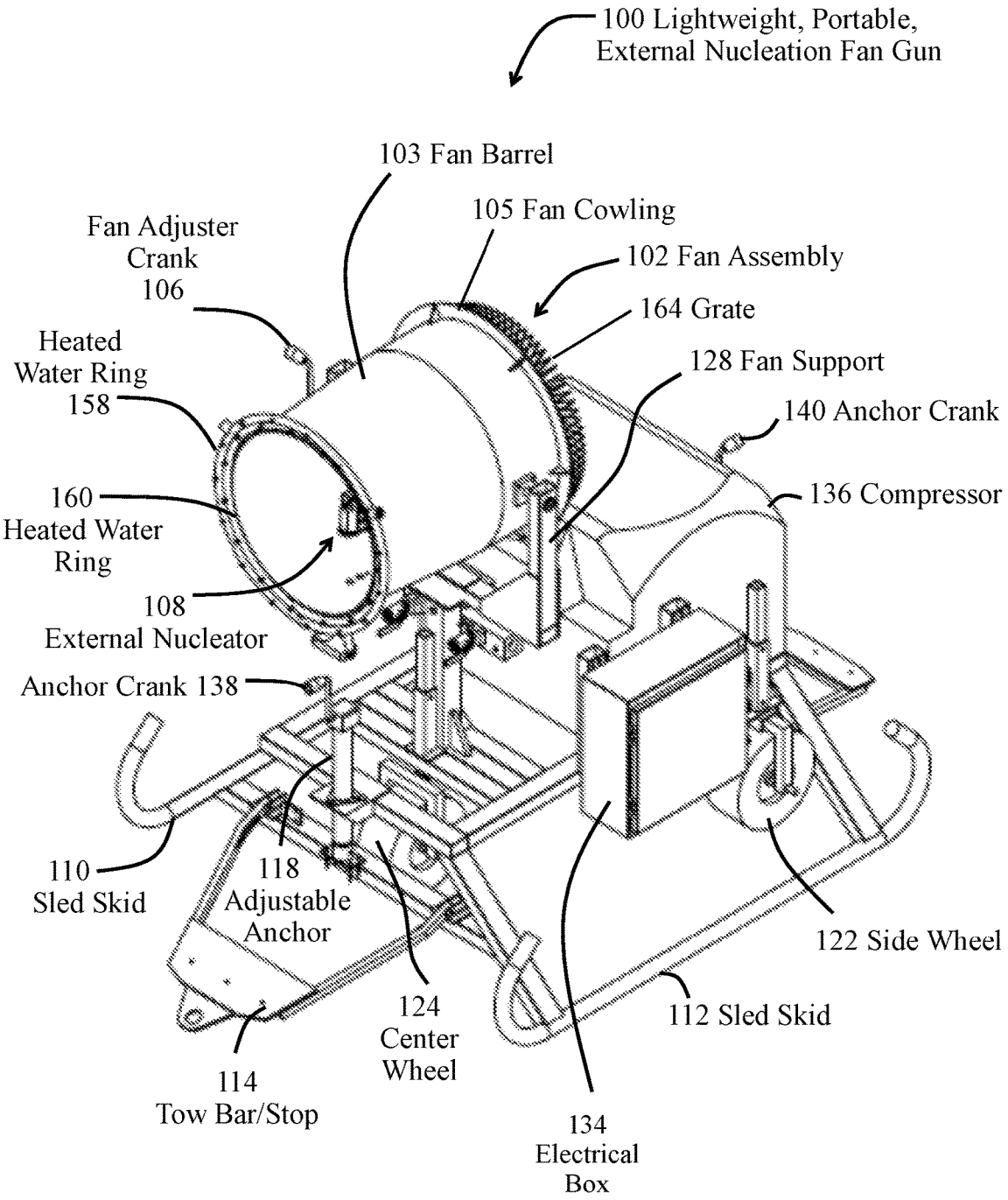
FIG. 1 is an isometric front view of an embodiment of a lightweight, portable, external nucleation fan gun.

FIG. 1 is an isometric view of a lightweight, portable, external nucleation fan gun 100 for making snow. The fan gun 100 is mounted on sled skids 110, 112 and can be towed or pulled over the snow in either a forward or backward direction by tow bar/stop 114, or tow bar/stop 115, respectively. The tow bar/stops 114, 115 function both as tow bars and stops. For example, if the lightweight, portable, external nucleation fan gun 100 is being towed by tow bar/stop 114 up a mountain by a snowmobile, or other transport device, the tow bar/stop 115 is pivoted so it simply slides over the snow, since the tow bar/stop 115 is pivotally connected to the frame of the fan gun 100. If the two bar/stop 114 becomes unhooked, the tow bar/stop 115 will dig into the snow and stop the fan gun 100 from sliding in a reverse direction. Of course, the same is true in the opposite direction. If the fan gun 100 is being towed by tow bar/stop 115, the tow bar/stop will dig into the snow and stop the fan gun 100 from moving in a reverse direction.

Figure 3:
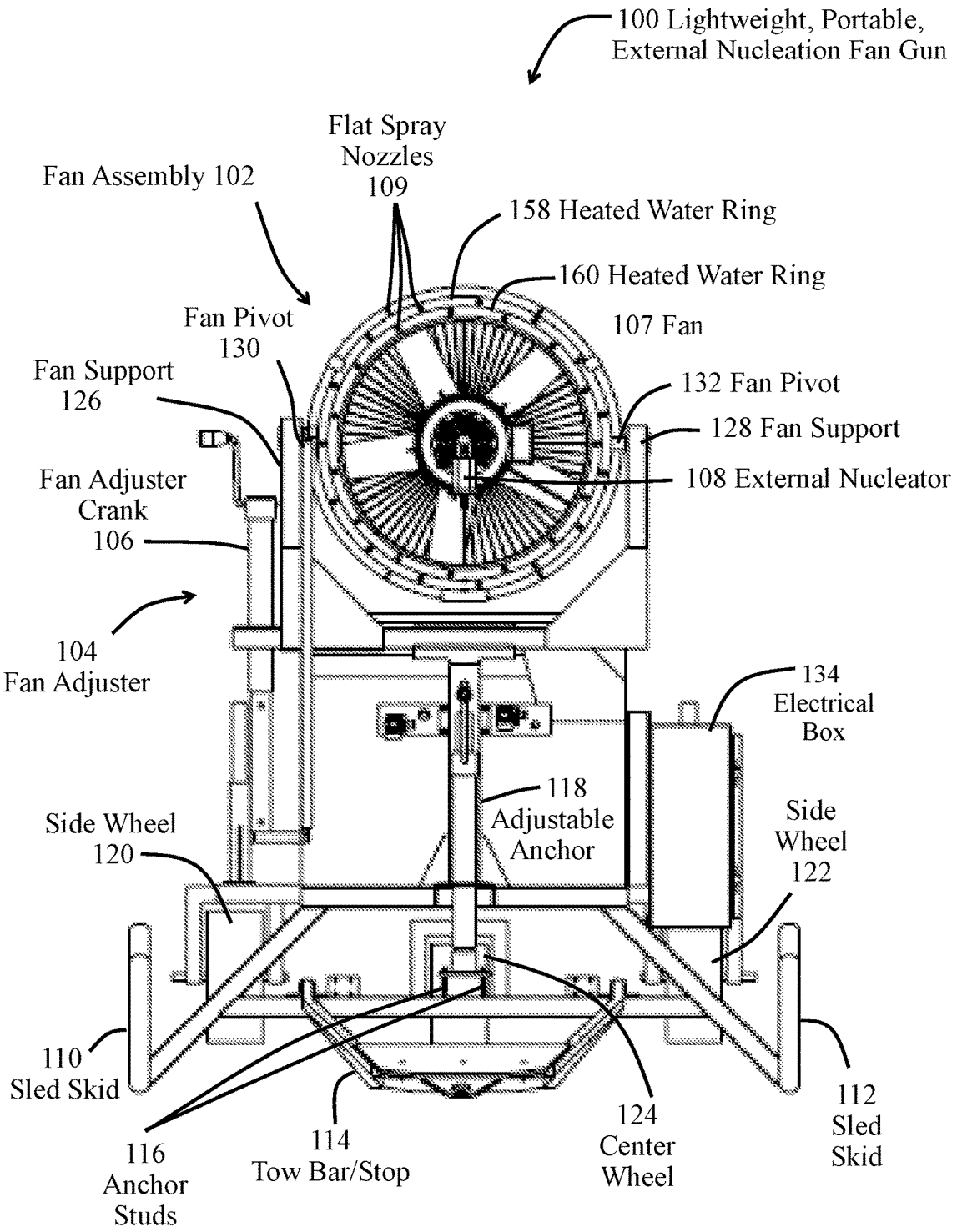
FIG. 3 is a front view of the embodiment of FIG. 1.

The fan gun 100, as illustrated in FIG. 1, has an onboard compressor 136. The electrical box 134 provides an electrical connection to a slope side electrical outlet, which powers the fan gun 100. The slope side connection also provides a supply of water to the fan gun 100. The fan gun 100 is connected to the supply of water at one of the predetermined locations that are located slope side that provide both electrical power and water. The fan gun 100 has a fan assembly 102. The fan assembly 102 has a grate 164 that is located on the intake side of the fan assembly 102. Air from the fan assembly 102 blows through the fan barrel 162 and exits out of the opening that is adjacent to heated water ring 158 and heated water ring 160. High velocity air from the fan assembly 102 blows out of the fan barrel 162 past the external nucleator 108 and heated water rings 158, 160. The orientation of the fan assembly 102 can be adjusted by a fan adjuster crank 106 that adjusts the fan adjuster 104 (FIG. 3). When the fan gun 100 is located in a position on the slope for use, an adjustable anchor 118 in the front portion of the fan gun 100 and an adjustable anchor 119 (FIG. 5) in the back of the fan gun 100 can be inserted in the snow or ice using anchor crank 138 and anchor crank 140, respectively. The adjustable anchors 118, 119 have anchor studs 116, 117 (FIG. 5) that will anchor the fan gun 100 in either snow or ice, so that the fan gun 100 is securely fixed in a desired position. In addition, the adjustable anchors 118, 120 can be used to raise the fan gun 100 so that the wheels, such as central wheel 124, side wheel 122, and side wheel 120 can be lowered and pinned in the down position, so that the fan gun 100 can be transported on non-snow and ice surfaces.

In operation, the lightweight, portable, external nucleation fan gun 100, illustrated in FIG. 1, uses a unique external nucleator 108 in a fan gun implementation, which creates nucleated particles which interact with the water droplets from the heated water rings 158, 160 to create the snow particles. As explained in more detail below, the external nucleator 108 simply creates nucleated particles so that the water droplets from the heated water rings 158, 160 can form the snowflakes that are created by the ambient cold air. A small misting nozzle is used to create a water mist that is then blown by a high pressure spray to create the nucleated particles that form frozen nuclei that form the basis for each of the flakes that are created from the water droplets of the heated water rings 158, 160. This process is explained in more detail with respect to the description of FIGS. 9 and 10 below.

Figure 2:
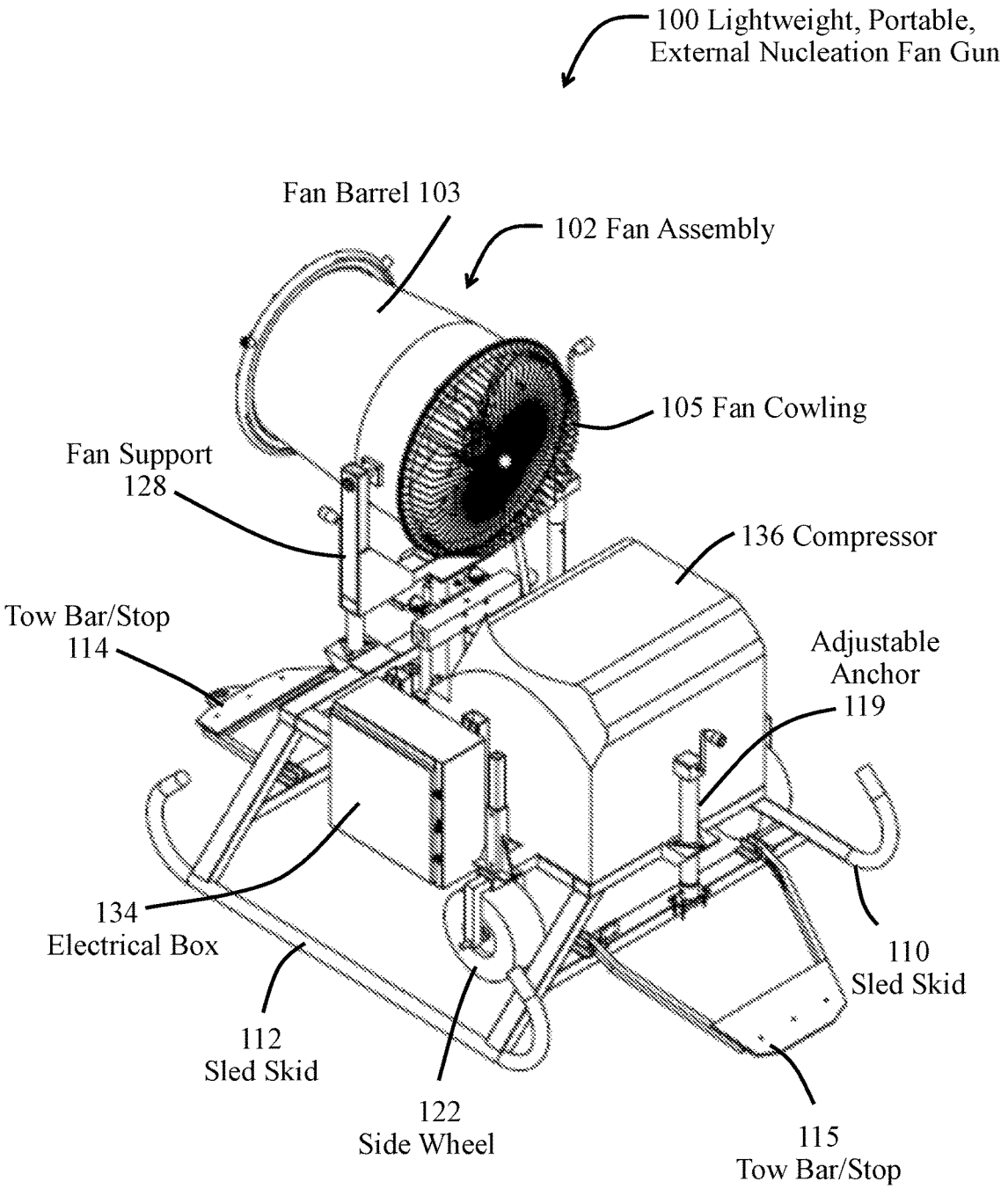
FIG. 2 is a rear isometric view of the embodiment of lightweight, portable, external nucleation fan gun of FIG. 1.

FIG. 2 is an isometric rear view of the lightweight, portable, external nucleation fan gun 100. As illustrated in FIG. 2, tow bar/stop 115 is connected by hinges to a cross support bar 156 (FIG. 8) that extends between sled skid 112 and sled skid 110. The adjustable anchor 119 is located on the back of the fan gun 100 and it includes studs and a crank handle for securing the fan gun 100 in ice and snow. Again, the adjustable anchor 119 can also be used to raise the fan gun 100 to place the side wheels, such as side wheel 122, in a down position, so that the fan gun 100 can be transported across non-snow and ice surfaces. The fan assembly 102 is supported by fan support 128 and fan support 126 (FIG. 3). As stated above, the electrical box 134 provides power from a local supply to operate the compressor 136, the fan assembly 102, and other functions of the fan gun 100.

FIG. 3 is a front view of the lightweight, portable, external nucleation fan gun 100. As illustrated in FIG. 3, the fan assembly 102 includes an external nucleator 108 that is mounted at the center of the fan assembly 102. Along the outer edges of the openings of the fan assembly 102 are heated water rings 158, 160 having flat spray nozzles 109. The flat spray nozzles 109 are wash nozzles that are used in car washes and power washers that create a flat fan-shaped spray, as described in more detail below. The fan 107 rotates and creates a column of air through the fan barrel 103. A misting or nucleation nozzle 144 (FIG. 9) on the external nucleator 108 generates a water mist that is intersected by a high pressure airflow from air nozzle 142 (FIG. 9) in the external nucleator 108. The atomized water mist freezes to create frozen nuclei or "snow seeds." The snow seeds are blown out through the opening by the fan 107. The frozen nuclei, or snow seeds, mix with the water droplets that are emitted by the flat sprayer nozzles 109 on the heated water rings 158, 160 that freeze in the ambient air to form snow. This is explained in more detail with respect to FIGS. 9 and 10.

FIG. 3 also illustrates fan support 126 and fan support 128. Fan support 126 is connected to the body of the fan assembly 102 with a fan pivot 130. Similarly, fan support 128 is connected to the body of the fan assembly 102 with fan pivot 132. Fan adjuster 104 adjusts the orientation of the fan with respect to the supporting structure. A fan adjuster crank 106 can adjust the attitude of the fan assembly 102. FIG. 3 also illustrates the electrical box 134, the adjustable anchor 118, side wheels 120, 122, and center wheel 124. The adjustable anchor 118 has anchor studs 116, which are capable of driving the adjustable anchor 118 into an icy surface to the hold the fan gun 100 in a stable position. Tow bar/stop 114 is used to either tow the fan gun 100 or stop it from moving backwards. Sled skids 110, 112 assist the fan gun in moving over ice and snow.

Figure 4:
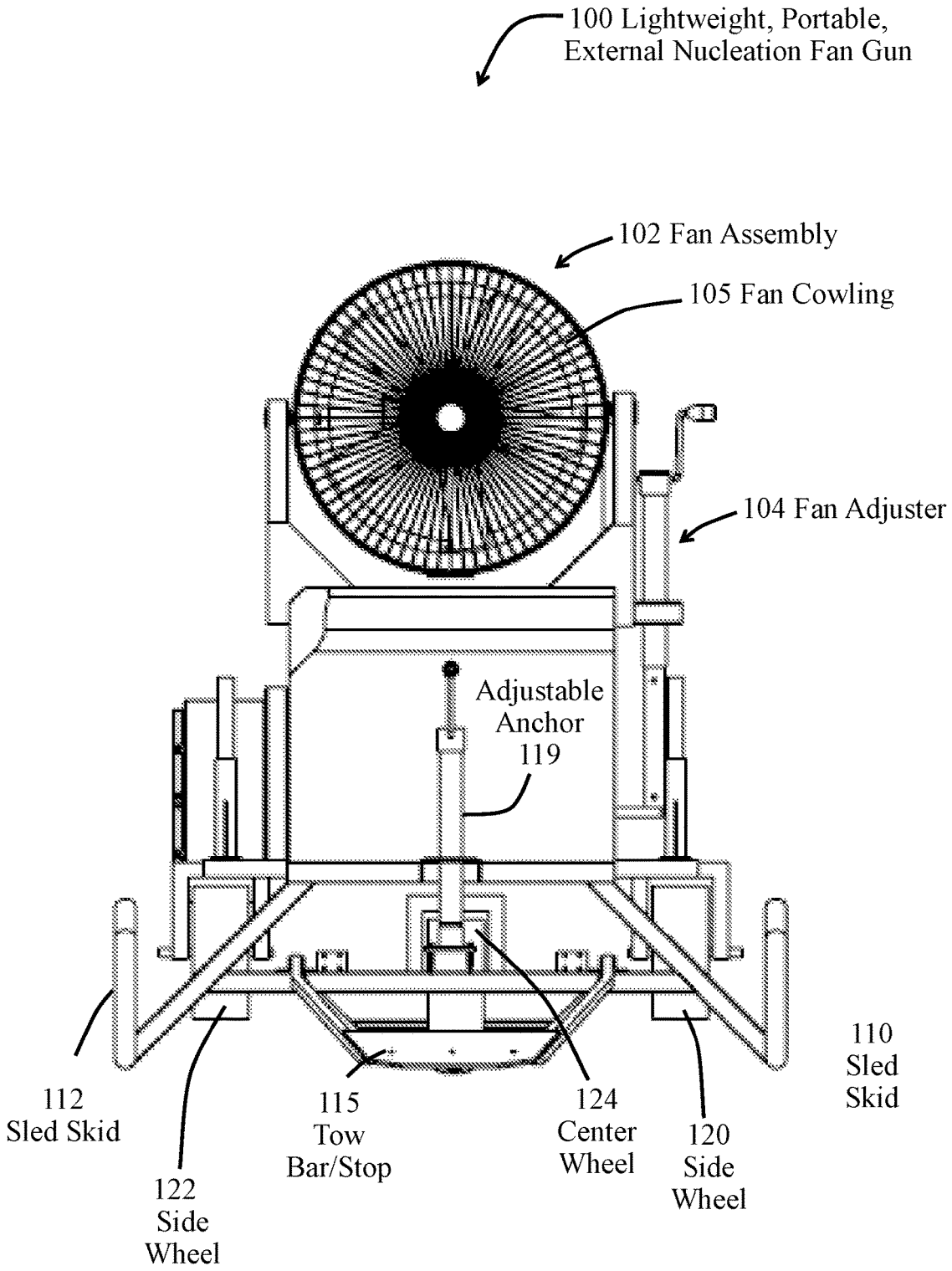
FIG. 4 is a rear view of the embodiment of FIG. 1.

FIG. 4 is a back view of the lightweight, portable, external nucleation fan gun 100. As shown in FIG. 4, the fan cowling 105 is illustrated on the rear portion of the fan assembly 102. As described above, the fan adjuster 104 is used to adjust the angle of the fan assembly 102. Side wheels 120, 122 and center wheel 124 are also illustrated in FIG. 4. Tow bar/stop 115 is connected to a cross member with pivots, so that the tow bar/stop 115 rests on the surface of the snow. Sled skids 110, 112 provide a sliding surface for the fan gun 100.

Figure 5:
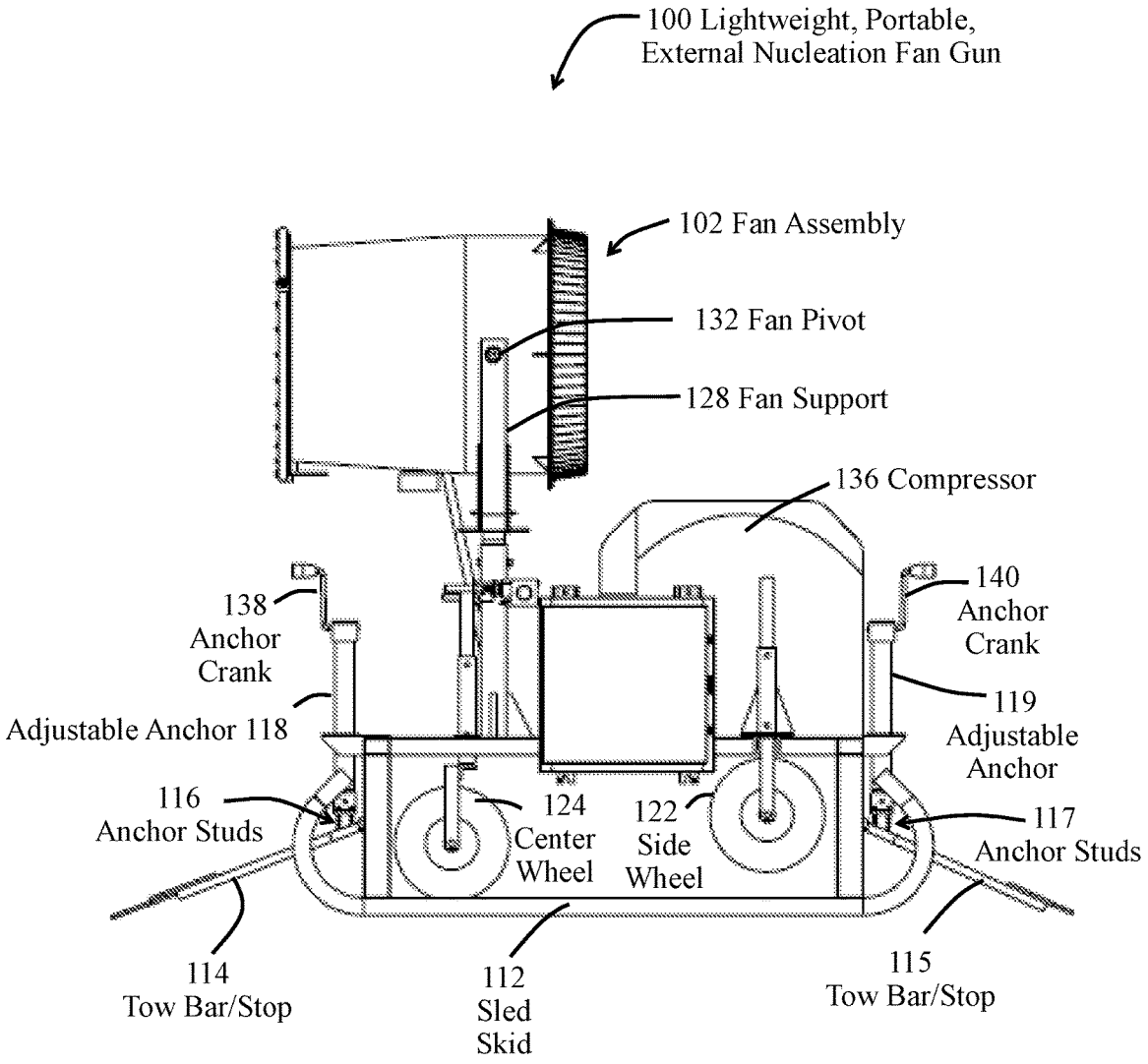
FIG. 5 is a left side view of the embodiment of FIG. 1.

FIG. 5 is a left side view of the lightweight, portable, external nucleation fan gun 100. The electrical box 134 and the compressor 136 are illustrated in FIG. 5. Center wheel 124 and side wheel 122 are shown in an upward position. The supports for the center wheel 124 and side wheel 122, as well as side wheel 120 (FIG. 3) have openings for using a pin to set the height of these wheels. Since the fan gun 100 has a weight that approaches 700 pounds, the adjustable anchors 118, 119 can be adjusted with the anchor cranks 138, 140, to raise the fan gun 100, so that the wheels can be pinned in a downward position for transport over hard surfaces. Anchor studs 116, 117 of adjustable anchors 118, 119, respectively, secure the adjustable anchors 118, 119 to any surface on which the fan gun 100 is located. The fan gun 100 can be towed by either tow bar/stop 114 or tow bar/stop 115. Again, the tow bar/stops 114, 115 are pivotally attached to the fan gun 100, so that when the fan gun 100 is being towed by one of the tow bar/stops, the other tow bar/stop rides against the snow or ice surface and will dig into the snow surface if the fan gun 100 is moved in a reverse direction. FIG. 5 also illustrates fan support 128, which includes a fan pivot 132 for mounting the fan assembly 102.

Figure 6:
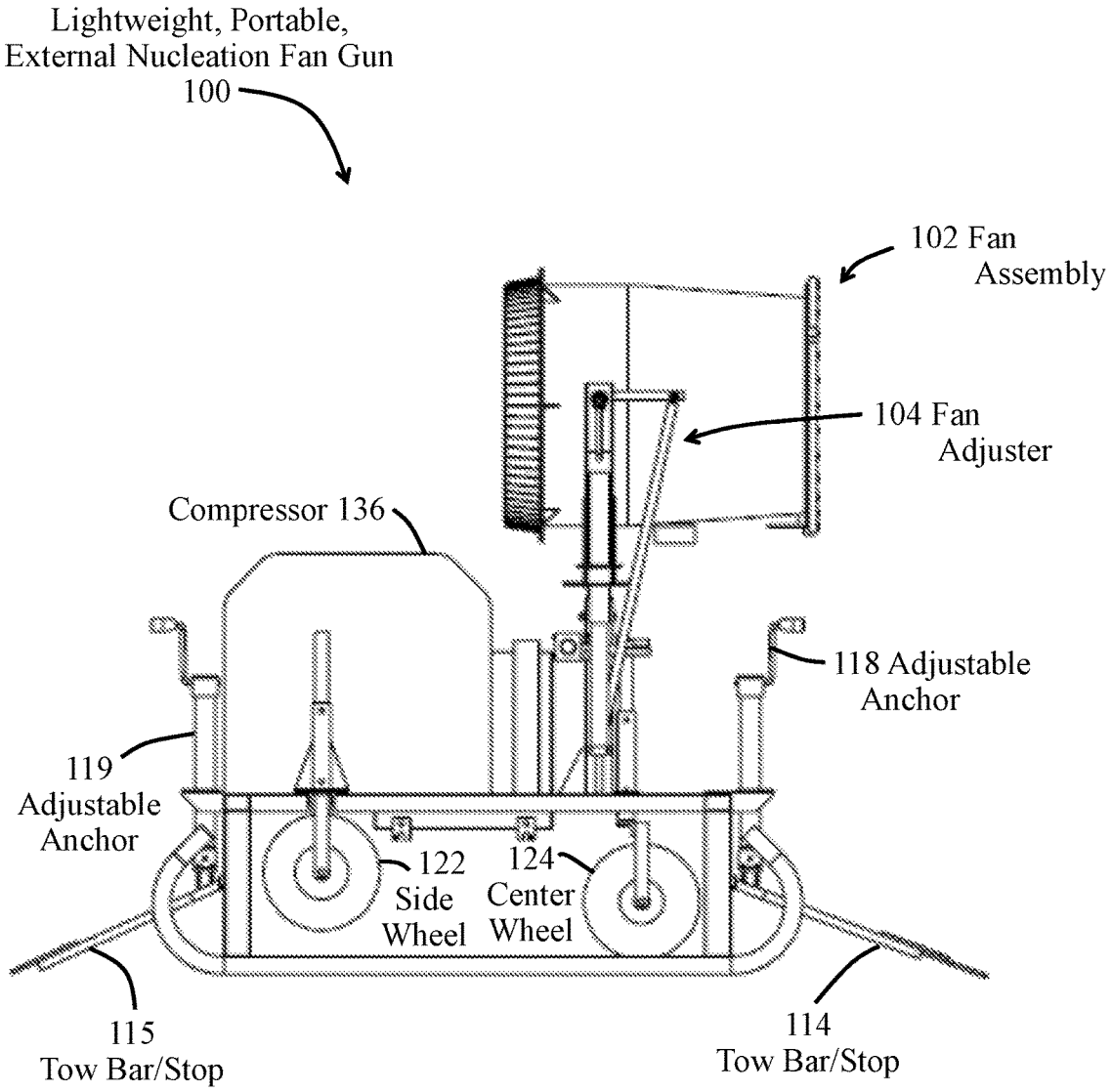
FIG. 6 is a right side view of the embodiment of FIG. 1.

FIG. 6 is a right side elevation view of the lightweight, portable, external nucleation fan gun 100. FIG. 6 illustrates the adjustable anchors 118, 119, side wheel 120 and center wheel 124. The tow bar/stop 114 and tow bar/stop 115 are also illustrated. As shown in FIG. 6, the compressor is mounted on a support surface of the fan gun 100. Fan adjuster 104 can be used to adjust the attitude or elevation of the fan assembly 102.

Figure 7:
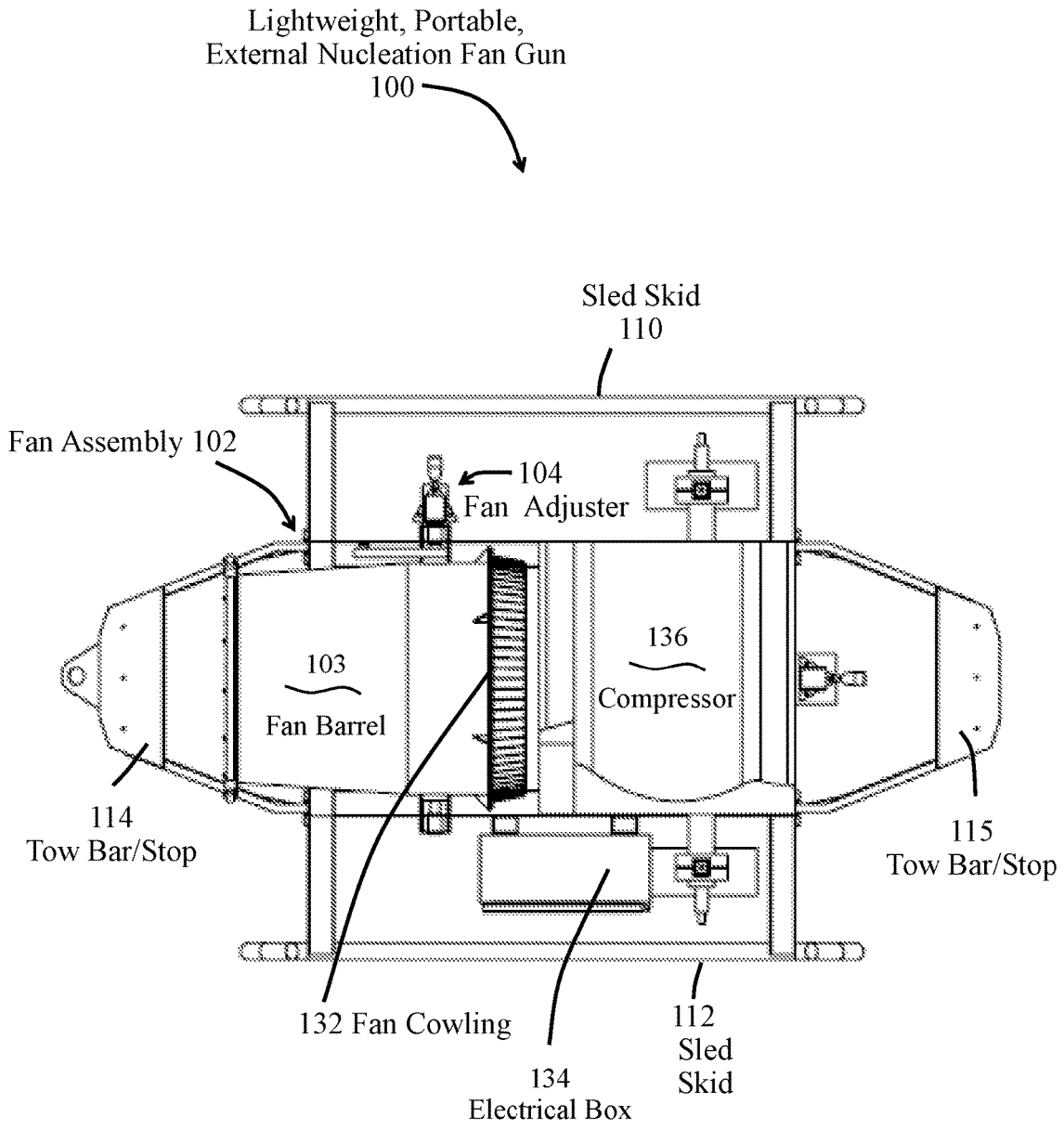
FIG. 7 is a top view of the embodiment of FIG. 1.

FIG. 7 is a top view of the lightweight, portable, external nucleation fan gun 100. As shown in FIG. 7, the fan assembly 102 includes the fan barrel 103 and fan cowling 105. The tow bar/stops 114, 115, as well as the sled skids 110, 112, are also illustrated. Fan adjuster 104 is attached to the fan barrel to adjust the elevation or attitude of the fan barrel 103. Electrical box 134 and compressor 136 are also illustrated.

Figure 8:
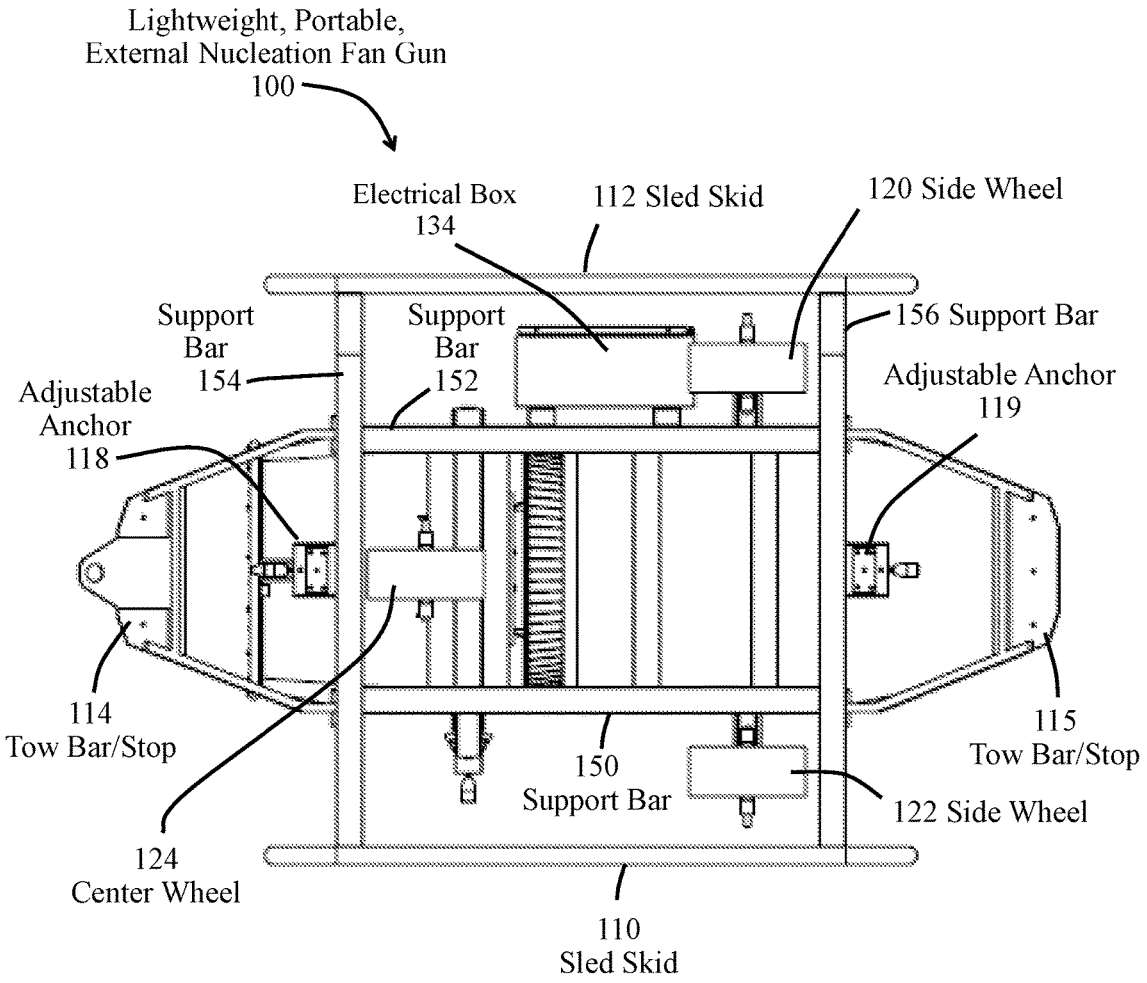
FIG. 8 is a bottom view of the embodiment of FIG. 1.

FIG. 8 is a bottom view of the lightweight, portable, external nucleation fan gun 100. As illustrated in FIG. 8, the orientation of the wheels are shown. For example, center wheel 124, as well as side wheels 120, 122, are shown in their positions on the fan gun 100. Adjustable anchor 118 can be lowered by a user so that the fan gun 100 is lifted in the front portion and the center wheel 124 can be positioned into a lowered position to engage a hard surface. The adjustable anchor 118 can then be raised and the adjustable anchor 119 can be lowered to position the side wheels 120, 122 in a lowered position to engage a hard surface. The fan gun 100 can then be towed by either tow bar/stop 114 or tow bar/stop 115 with the side wheels 120, 122 and center wheel 124 engaging a hard surface, such as the ground or a street. Support bars 154, 156 are connected to the sled skids 110, 112. Support bars 150, 152 are connected to the support bars 154, 156 to form a box structure for the fan gun 100. The structure is constructed of aluminum to minimize the weight and allow the fan gun 100 to be towed with transports such as snowmobiles. Also illustrated in FIG. 8 are the tow bar/stops 114, 115 and the electrical box 134.

Figure 9:
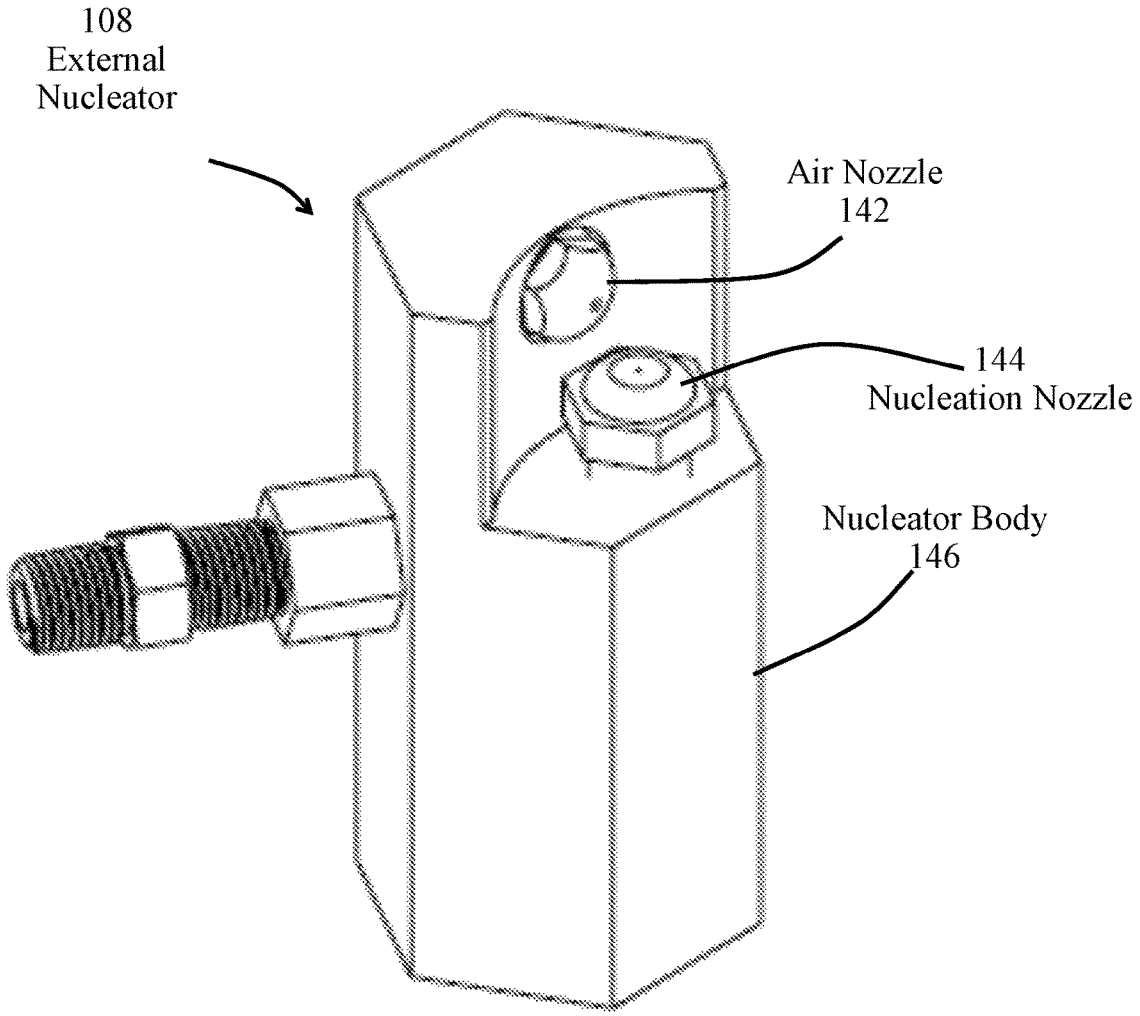
FIG. 9 is a perspective view of an embodiment of an external nucleator.

FIG. 9 is a perspective view of the external nucleator 108. The external nucleator has a nucleator body 146. Mounted in the body is an air nozzle 142 and a nucleation nozzle 144. The nucleation nozzle 144 is a misting nozzle and has an opening of about 0.01 inches. Water is applied to the nucleation nozzle 144 at a pressure of approximately 500 psi, but pressures of 250 psi to 650 psi can be used. This creates a very fine mist of very small water particles. The air nozzle 142 is mounted substantially transverse to the nucleation nozzle 144 and creates a strong air blast that intersects the water mist from the nucleation nozzle 144 and further breaks down the water particles to even smaller water particles, The misting nozzles are referred to as atomizing water nozzles that are sold by Danfoss Hago, Inc., 1120 Global Avenue, Mountainside, New Jersey, 07092. The type M2 nozzle has a spray angle of approximately 80° . When 500 psi water pressure is applied to the atomizing water nozzle, a very fine mist of water nuclei are created. These types of nozzles are normally used in greenhouses to create a water mist that lands on the leaves of the plants, and in public areas for creating a cooling mist for people, The water pressure ideally is about 500 psi, but works well between 250 psi up to 650 psi. The air nozzle 142 has an approximately ⅛ inch opening and is located approximately ¼ inch from the atomized water mist from the nucleation nozzle 144. The air pressure applied to the air nozzle 142 may be approximately 100 psi.

Figure 10:
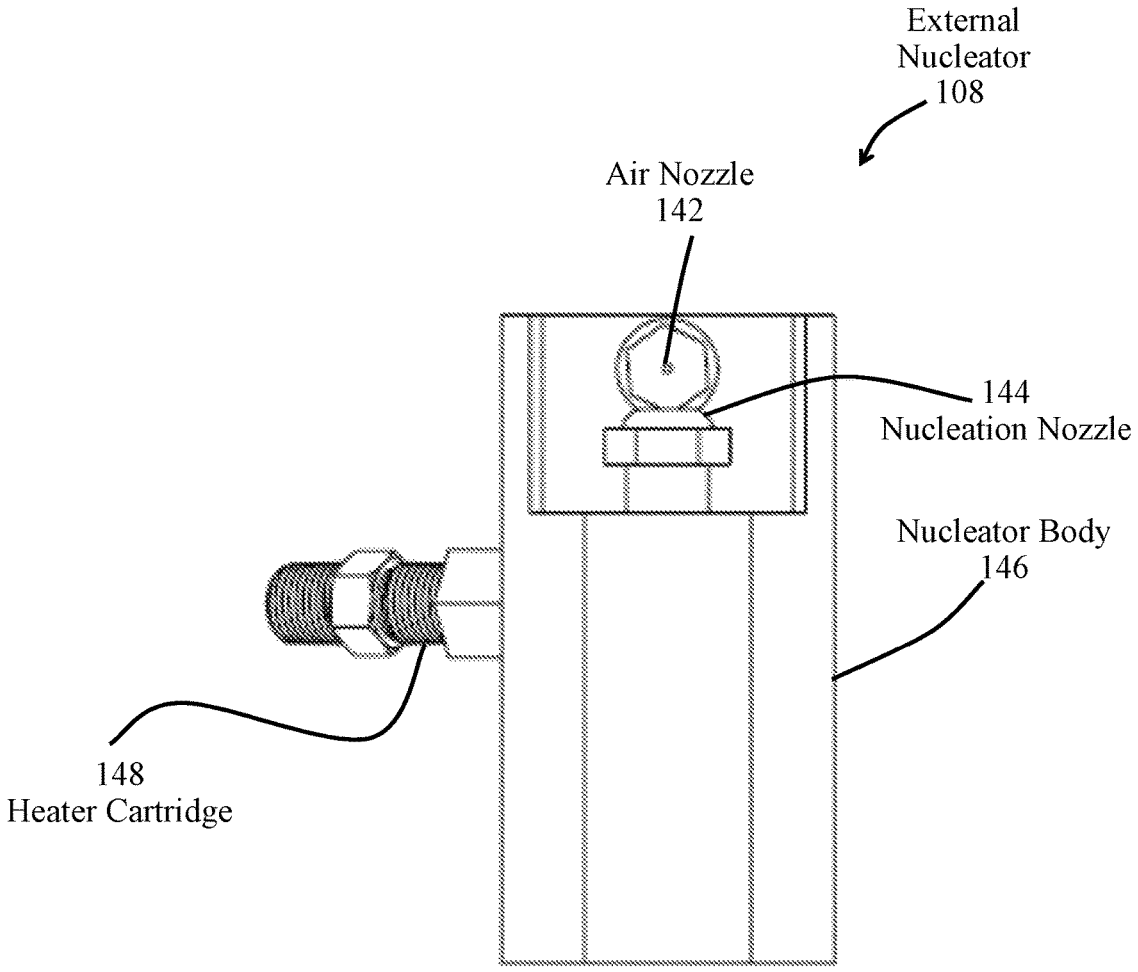
FIG. 10 is a front view of the external nucleator of the embodiment of FIG. 9.

As also illustrated in FIG. 9, the compressed air from the air nozzle 142 is spaced apart from the atomized water mist from the nucleation nozzle 144, so that the air flow intersects all, or substantially all, of the atomized water mist exiting from the nucleation nozzle 144. Nucleators that have been used on fan guns and tower/ground guns use internal nucleation. Internal nucleators operate by creating water droplets in an internal chamber and then shoot the water droplets through one or more nozzles using air pressure. The shape of the internal mixing chamber and the number of nozzles may vary. In addition, the manner in which the water droplets are created in the internal chamber may also vary in internal nucleators. The problem with the internal nucleators is that they may be difficult to drain and may freeze easily. Also, repairs and maintenance of internal nucleators are difficult. The external nucleator, illustrated in FIGS. 9 and 10, is simple and easy to maintain. The external nucleator disclosed in FIG. 10 has only three operating parts, which are the air nozzle 142, nucleation nozzle 144, and heater cartridge 148. All of these components can be accessed and replaced from the exterior of the external nucleator 108. If any of these components break down or become warn, these components are easily replaced from the outside of the external nucleator 108.

The small nucleation nozzle 144, illustrated in FIG. 9, has an opening that is only 0.01 inches that creates a mist having water particles that are substantially smaller than internal nucleators. Additionally, by causing the small atomized water mist to intersect at a substantially 90° angle with expanded compressed air, the expanded compressed air causes the water particles to break apart and be propelled outwardly, away from the external nucleator, as a result of the high velocity of the expanded compressed air and the air from the fan assembly 102. At 100 psi, the expanded compressed air that is emitted from the ⅛ inch air nozzle 142 is sufficiently close to the atomized water mist from the nucleation nozzle 144 to further break apart the atomized water mist. Internal nucleators do not have an external air nozzle that further breaks apart the water particles and cause the water particles.

Further, when compressed air expands, there is a large absorption of heat, so that the expanded air flow from the air nozzle 142 is very cold. The expanded compressed air is sufficiently cold to substantially instantaneously freeze the broken apart atomized water mist to create frozen nuclei or "snow seed." The air blast from the expanded compressed air that flows from the air nozzle 142 is sufficiently close to the nucleation nozzle 144 to both freeze the atomized water mist and break apart the atomized water mist into even smaller particles. Since the air nozzle 142 and nucleation nozzle 144 are in open air, the ambient temperature of the air assists in causing the broken apart atomized water mist to freeze. The spacing between the air nozzle 142 and the nucleation nozzle 144 is approximately ¼ inch, but can vary to create the desired effect. The distance between the air nozzle 142 and the nucleation nozzle 144 is also dependent upon the dispersion angle of the atomized water mist that is emitted from the nucleation nozzle and the dispersion angle of the air emitted from the air nozzle 142. In addition, that distance is also dependent upon the desired velocity of the air that is emitted from the air nozzle 142 to break apart the atomized water mist and create frozen nuclei. These frozen nuclei are blasted outwardly out of the fan barrel 103 by both the air blast from the air nozzle 142 and by the large column of air that is created by the fan 107 that travels through the fan barrel 103 out of the opening of the fan barrel 103. Because of the fan blades 107 create a non-laminar flow through the fan assembly 102, which generally has a columnar shape, the frozen nuclei mix with droplets from the flat spray nozzles 109 in the cone-shaped air flow.

The heated water rings 158, 160 (FIG. 3) utilize "Washjet" sprayers (a trademark of Spraying Systems Co.) that are available from Spraying Systems Co., North Avenue and Schmale Road, P.O. Box 7900, Wheaton, Ill. 60187-7901 and its local representatives, which are referred to above as flat spray nozzles 109, shown in FIG. 3. The flat spray nozzles 109 are washer spray nozzles that are used, for example, in car washes that create a flat fan-shaped spray. These flat spray nozzles 109 are similar to power wash nozzles that create a flat fan spray. For example, in one embodiment of the invention, the flat spray nozzles 109 create a 15° fan spray using a ⅛ inch opening using the MEG spray nozzle available from Spraying Systems Co. Typical spray nozzles used in fan gun type snow making equipment create a cone-shaped spray, rather than a fan-shaped spray. The advantage of a fan-shaped sprayer is that the spray is dispersed over a wide, flat plain at 15°, or other desired angle, so that the water spray is dispersed over a larger area. Although a 15° ⅛ inch sprayer is used, in accordance with one embodiment, the flat spray nozzles 109 can create a fan spray of up to 80°, which further increases the distribution of water droplets in the atmosphere. When the column of air from the fan assembly 102 hits the fan spray from the flat spray nozzles 109, the water droplets in the fan spray are broken apart and propelled outwardly from the fan gun into the cold, ambient air. The frozen nuclei (snow seed) from the external nucleator 108 are also propelled outwardly by the columnar-shaped air formed by the fan assembly 102, so that the frozen nuclei, or snow seed, combine with the water droplets from the flat spray nozzles 109 to create snow. The fan assembly 102 is capable of blowing both the snow seed and the water droplets from the flat spray nozzles 109 out to 100 feet or more. The cold, ambient air allows the moisture droplets and frozen nuclei to combine and freeze to create snowflakes. The disbursement of the water droplets by the flat spray nozzles 109 over a greater area allows for better and more efficient creation of snowflakes from the fan gun 100. The flat spray nozzles 109 that create the fan spray are readily available on the market from various sources and are less expensive than the cone nozzles used on other fan gun snowmakers and operate more efficiently than other nozzles, as described above.

FIG. 10 is a front view of the external nucleator 108. As illustrated in FIG. 10, the nucleation nozzle 144 is mounted just below the air nozzle 142. Heater cartridge 148 is connected internally in the nucleator body 146 and is connected to an electrical power source to provide heat to the nucleator body, which prevents freezing of the external nucleator 108.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A method of making snow using a fan gun comprising:

providing a structure for said fan gun;

using a fan mounted on said structure, that blows air through a fan barrel to generate a column of air exiting said fan barrel;

creating an atomized water mist of water nuclei in open air using an external nucleator by passing water under pressure through a nucleation nozzle;

generating an expanded flow of compressed air using an air nozzle that intersects said atomized water mist in open air, said air nozzle located sufficiently close to said nucleation nozzle and having a sufficient high pressure to break apart water particles of said atomized. water mist, and said expanded flow of compressed air being sufficiently expansive to freeze broken apart water particles of said atomized water mist, in open air, to create frozen water nuclei;

creating a fan-shaped water spray using spray nozzles located at an. opening of said fan barrel that intersect said column of air so that said fan-shaped spray and said frozen nuclei are projected by said column of air from said fan barrel and combine to create snowflakes.

2. The method of claim 1 further comprising:

providing sled skids and retractable wheels for movement of said structure over both snow and non-snow surfaces;

providing adjustable anchors that also function as jacks to raise and lower said adjustable wheels on said fan gun.

3. The method of claim 1 wherein said process of providing said structure comprises:

providing a structure that is constructed of aluminum.

4. The method of claim 1 further comprising:

using tow bars on each end of said structure, which function as stops that restrict movement in a reverse direction when not being used as a tow bar.

5. A fan gun for making snow comprising:

a support structure;

retractable wheels connected to said support structure;

sled skids connected to said support structure;

a fan barrel mounted on said structure;

a fan connected to said fan barrel and disposed to blow air through said fan barrel and create a column of air that is projected out of said fan barrel;

an external nucleator comprising:

a nucleation nozzle that creates an atomized water mist by passing pressurized water through an opening in said nucleation nozzle;

an air nozzle that generates an expanded flow of air from compressed air applied to said air nozzle, said air nozzle positioned to intersect said atomized water mist, said air nozzle located sufficiently close to said nucleation nozzle and sufficiently expansive to break apart water particles of said atomized water mist and freeze broken apart water particles, in open air, to create frozen water nuclei;

at least one water ring disposed proximate to an opening of said fan barrel;

a plurality of spray nozzles disposed on said water ring that create a fan shaped spray of water that is projected into said column of air that is projected out of said fan barrel so that said frozen nuclei combine with said spray of water to create snowflakes.

6. The fan gun of claim 5 wherein said external nucleator is disposed in said fan barrel proximate to said opening in said fan barrel.

7. The fan gun of claim 6 wherein said compressed air is approximately 100 psi.

8. The fan gun of claim 7 further comprising sled skids for moving said fan gun over snow and ice surfaces.

9. The fan gun of claim 6 further comprising adjustable wheels that allow said fan gun to be moved over non-snow surfaces.

10. The fan gun of claim 6 further comprising adjustable anchors that also function as jacks to raise and lower said retractable wheels.

11. The fan gun of claim 10 further comprising tow bars pivotally connected to said structure that function as both tow bars for towing said fan gun and as stops that prevent said fan gun from moving in a reverse direction.

12. An external nucleator for use in a fan gun for making snow comprising:

a nucleation nozzle that creates an atomized water mist in open air by passing pressurized water through an opening in said nucleation nozzle;

an air nozzle that generates an expanded flow of air from compressed air applied to said air nozzle, said air nozzle positioned on said external nucleator to intersect said atomized water mist in open air at a distance that is sufficiently close to said nucleation nozzle and said compressed air having a pressure that is sufficient to break apart water particles of said atomized water mist and freeze broken apart water particles to create frozen water nuclei.

13. A method of making snow using a fan gun comprising:

generating a column of air using a fan that blows air through a fan barrel;

creating an atomized water mist in open air by passing pressurized water through a nucleation nozzle in an external nucleator;

causing a flow of expanded air from pressurized air applied to an air nozzle to intersect said atomized water mist in open air, said flow of expanded air having a velocity that is sufficient to break apart water particles in said atomized water mist, and said flow of expanded air being expanded sufficiently to freeze broken apart water particles of said atomized water mist to create frozen water nuclei;

transporting said frozen water nuclei in said column of air:

creating a spray of water droplets using spray nozzles that is projected in said column of air so that said water droplets combine with said frozen water nuclei to create snow.

* * * * *